US005104302A

United States Patent [19]

Richardson, Jr.

[11] Patent Number: 5,104,302

[45] Date of Patent: Apr. 14, 1992

[54] SCROLL COMPRESSOR INCLUDING DRIVE PIN AND ROLLER ASSEMBLY HAVING SLIDING WEDGE MEMBER

[75] Inventor: Hubert Richardson, Jr., Brooklyn, Mich.

[73] Assignee: Tecumseh Products Company, Tecumseh, Mich.

[21] Appl. No.: 649,893

[22] Filed: Feb. 4, 1991

[51] Int. Cl.[5] ..... F04C 18/04

[52] U.S. Cl. ..... 418/55.5; 418/55.6; 418/57

[58] Field of Search ..... 418/55.5, 55.6, 57

[56] References Cited

U.S. PATENT DOCUMENTS

| | | | |
|---|---|---|---|
| 196,732 | 10/1877 | Winkler | 418/57 |
| 4,609,334 | 9/1986 | Muir et al. | 418/57 |
| 4,715,796 | 12/1987 | Inaba et al. | 418/57 |
| 4,730,998 | 3/1988 | Kakuda et al. | 418/57 |
| 4,764,096 | 8/1988 | Sawai et al. | 418/57 |
| 4,767,293 | 8/1988 | Caillat et al. | 418/57 |
| 4,808,094 | 2/1989 | Sugimoto et al. | 418/1 |
| 5,011,384 | 4/1991 | Grunwald et al. | 418/55.5 |

FOREIGN PATENT DOCUMENTS

| | | | |
|---|---|---|---|
| 61-215480 | 9/1986 | Japan | 418/55.5 |

*Primary Examiner*—John J. Vrablik
*Attorney, Agent, or Firm*—Baker & Daniels

[57] ABSTRACT

A swing-link radial compliance mechanism for scroll compressors which minimizes the damage and wear caused by chattering vibrations. The eccentric crankpin has a planar surface and a wedge is disposed in the bore of the roller, between the planar surface of the crankpin and the arc surface of the roller. The wedge has a flat surface for transferring chattering vibrations focused on an axial line of force to the planar surface of the crankpin. Also, an arcuate surface of the wedge engages the arc surface of the roller and allows for rocking movement of the wedge.

20 Claims, 3 Drawing Sheets

SCROLL COMPRESSOR INCLUDING DRIVE PIN AND ROLLER ASSEMBLY HAVING SLIDING WEDGE MEMBER

BACKGROUND OF THE INVENTION

The present invention relates to scroll compressors having swing-link radial compliance drive mechanisms. More specifically, the field of the invention is that of bearing arrangements between a crankshaft crankpin and a pivoting roller of the swing-link drive mechanism.

One example of a scroll compressor is found in U.S. Pat. No. 4,875,838, assigned to the assignee of the present invention, the disclosure of which is expressly incorporated by reference. In such a scroll compressor, a movable scroll wrap is disposed within a fixed scroll wrap, and a swing-link drive mechanism translates orbiting and rotating motion from an eccentric crankpin on the end of a crankshaft to an orbiting motion of the movable scroll wrap within the fixed scroll wrap. The orbiting scroll wrap is prevented from rotating about its own axis by a conventional Oldham ring assembly.

During operation of a scroll-type compressor, the pressure of compressed refrigerant at the interface between the scroll members tends to force the scroll members axially and radially apart, thereby permitting high to-low pressure leakage between compression pockets that reduces the operating efficiency of the compressor. Consequently, axial and radial compliance of the orbiting scroll member toward the fixed scroll member is required in order to maintain the scroll members in sealing contact with one another. Several methods for achieving axial and radial compliance have been developed, and are widely used in scroll-type compressors.

One method of achieving radial compliance in a scroll-type compressor is to utilize a swing-link radial compliance drive mechanism of the type disclosed in U.S. Pat. No. 4,875,838. Generally, the swing-link drive mechanism includes a roller pivotally journalled about an eccentric crankpin for imparting orbiting motion to the movable scroll wrap and, at the same time, causing the movable scroll wrap to radially comply with the fixed scroll wrap. Specifically, the eccentric crankpin on the crankshaft is received within an eccentric axial bore of a cylindrical roller, whereby the roller is eccentrically journalled about the eccentric crankpin. The roller and crankpin assembly is then received within a cylindrical well formed on the bottom surface of the orbiting scroll wrap, whereby rotation of the crankshaft causes the orbiting scroll wrap to orbit.

Ideally, the fixed and orbiting scroll wraps would have perfectly matching and perfectly smooth surfaces and, consequently, the swing-link mechanism would operate smoothly, i.e., the roller would experience no movement relative to the crankpin or the roller would pivot smoothly to promote sealing engagement between the involute scroll wraps. In either case, a sufficient oil film would be maintained between the crankpin and roller to minimize wear. However, in practical situations the wraps contain minor imperfections that adversely affect the operation of the swing-link mechanism.

Imperfections in the geometry and/or surface finish of the wraps result in perturbations during operation of the swing-link mechanism, which cause chattering of the roller relative to the crankpin. Chattering vibrations result in rapid back and forth movement of the roller relative to the crankpin with an extremely small, almost microscopic, displacement. Meanwhile, a driving force is focused in the direction of a line that is tangential to the orbiting motion of the crankpin and roller, with the force being applied at a line of contact on the circumference of the crankpin onto the roller. The chattering is so small that an oil film cannot be established between the crankpin and roller surfaces, and so fretting occurs. Fretting is a condition where the molecular bonds between the materials at the line of contact are broken down and very severe and localized wear occurs. The chattering vibrations are totally random, and depend on the perturbations which occur as the fixed and orbiting scroll wraps engage.

Another type of radial compliance mechanism used in a prior art scroll compressor includes a cylindrical unloading drive bushing having an axial bore in which is drivingly disposed an eccentric crankpin. The axial bore is slightly oval in cross-section, and includes a flat bearing insert disposed in the wall of the bore. A flat on the crankpin slidably engages the flat bearing insert as the crankpin drives the brushing. The oval cross-section of the bore permits limited sliding movement between the crankpin and bushing, in order to achieve radial compliance and unloading.

However, a problem inherent with the aforementioned radial compliance mechanism is that vibrations from a change in load tends to cause noise and premature wear of the crankpin and roller. When the compressor starts-up, for example, the loose-fitting crankpin may shake and cause noise, or when the compressor changes speeds the loose-fitting crankpin may shift position slightly and rattle. In either case, the additional noise is undesirable and the additional wear should be avoided.

What is needed is a radial compliance mechanism that minimizes the problems associated with chattering vibrations between the crankpin and roller.

Also needed is a radial compliance mechanism that can be incorporated into existing compressor designs.

A further need is for a radial compliance mechanism that is relatively easy to manufacture.

SUMMARY OF THE INVENTION

The present invention is a bearing arrangement for a swinglink radial compliance drive mechanism of a scroll compressor that minimizes the noise and wear caused by chattering vibrations. The line of contact between the crankpin and the bore of the roller includes a bearing cavity and a wedge which distributes the chattering vibrations over a greater portion of the crankpin.

The perturbations caused by the imperfections in the scroll wraps may cause fretting and severe localized wear. The present invention provides a means for distributing the effect of the chattering vibrations resulting from the perturbations. Further, the present invention can be incorporated into existing designs because only the shape of the crankpin differs in that a planar surface is formed facing the direction of the radially outwardly biased force which the crankpin imparts to the roller. The wedge has a shape that is relatively easy to manufacture.

The wedge also aids in the lubrication of the crankpin/roller interconnection because it rocks back forth to induce the flow of oil into small gaps between the wedge and the arc surface of the bore. The arcuate surface of the wedge has a shape that does not perfectly fit the arc surface of the bore of the roller, allowing some freedom of movement for the wedge. Thus, where in the prior art mating cylindrical surfaces of the crankpin and roller did not have the benefit of lubricating oil because the chattering vibrations did not create sufficiently significant movement to induce oil flow, the present invention has a rocking wedge which induces oil flow at the point of maximum applied force.

The present invention, in one form, comprises a hermetic scroll compressor for compressing refrigerant fluid. The compressor comprises a housing, a scroll compressor mechanism, a crankshaft, and a roller. The scroll compressor mechanism is disposed within the housing, and includes a fixed scroll and an orbiting scroll with a cylindrical well. The rotatable crankshaft has one of an eccentric crank portion and an eccentric cylindrical bore. The roller has the other one of the eccentric crank portion and the eccentric cylindrical bore, wherein the eccentric crank portion is disposed within the eccentric cylindrical bore. The roller is also rotatably journalled within the cylindrical well to impart radially outwardly biased force to the orbiting scroll upon rotation of said crankshaft. The eccentric crank portion has a generally cylindrical outer surface corresponding to the shape of the cylindrical bore with a planar surface interrupting the generally cylindrical outer surface. The planar surface and an arc surface of the cylindrical bore define a bearing cavity. The wedge is disposed within the bearing cavity; and the wedge includes an arcuate surface adjacent the arc surface of the cylindrical bore, and a flat surface adjacent the planar surface which together form a bearing contact whereby the roller and the crankshaft cause chattering vibrations and the wedge transmits the chattering vibrations along the planar surface.

One object of the present invention is to provide a radial compliance mechanism that minimizes the problems associated with chattering vibrations between the crankpin and roller.

Another object is to provide a radial compliance mechanism that can easily be incorporated into existing designs.

A further object is to provide a radial compliance mechanism that is relatively easy to manufacture.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
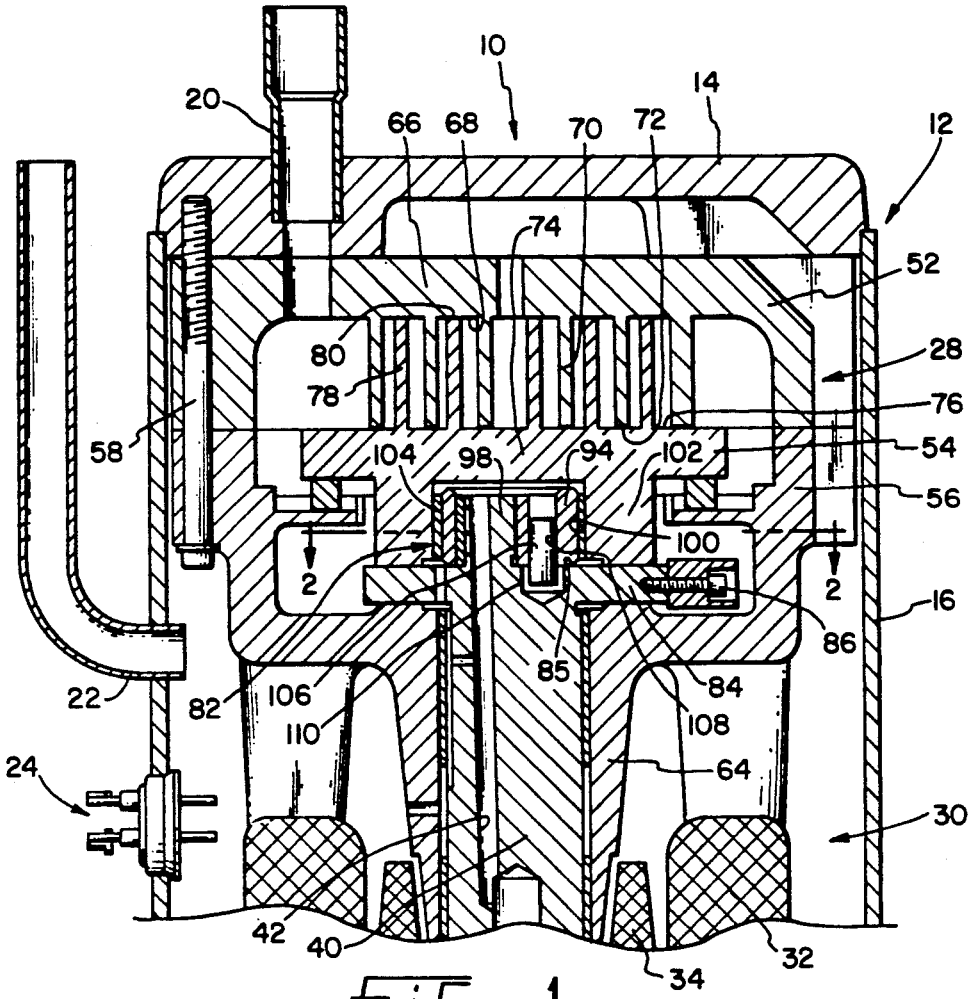
FIG. 1 is an elevational view, in partial cross section, of the upper portion of a scroll compressor.

The present invention comprises hermetic scroll-type compressor 10 as depicted in FIG. 1. Compressor 10 includes a housing 12 having a top cover plate 14, a central portion 16, and a bottom portion (not shown), all of which are hermetically joined, as by welding. Housing 12 is disposed in a vertically upright position and includes suction inlet 20, discharge outlet 22, and electrical terminal cluster 24.

Disposed within housing 12 is a motor-compressor unit comprising scroll compressor mechanism 28 and electric motor 30. Motor 30 includes stator 32 and rotor 34 secured to crankshaft 40. An oil sump (not shown) is provided generally in the bottom portion of housing 12. Oil is provided to scroll compressor mechanism 28 by passage 42 of crankshaft 40 in a known manner as disclosed in the aforementioned U.S. Pat. No. 4,875,838. Compressor mechanism 28 generally comprises fixed scroll member 52, orbiting scroll member 54, and frame member 56. As shown in FIG. 1, fixed scroll member 52 and frame member 56 are secured together and are attached to top cover plate 14 by means of a plurality of mounting bolts 58. Frame member 56 includes bearing portion 64 in which crankshaft 40 is rotatably journalled.

Fixed scroll member 52 comprises generally flat plate portion 66 having face surface 68, and involute fixed wrap 70 extending axially from surface 68 and having wrap tip surface 72. Likewise, orbiting scroll member 54 comprises generally flat plate portion 74 having top face surface 76, and involute orbiting wrap 78 extending axially from surface 74 and having wrap tip surface 80. Fixed scroll member 52 and orbiting scroll member 54 are operably intermeshed such that wrap tip surfaces 72, 80 of wraps 70, 76 sealingly engage with respective opposite face surfaces 74, 68.

The upper end of crankshaft 40 includes eccentric drive mechanism 82, which drivingly engages the underside of orbiting scroll member 54. Crankshaft 40 also includes thrust plate 84, intermediate orbiting scroll member 54 and frame member 56, attached to which counterweight 86 is attached. Orbiting scroll member 54 is prevented from rotating about its own axis by means of a conventional Oldham ring assembly, comprising Oldham ring 88, and Oldham key pairs 90, 92 associated with orbiting scroll member 54 and frame member 56, respectively.

Eccentric drive mechanism 82 comprises cylindrical roller 94 having axial bore 96 located off-center the cylindrical axis of roller 94. Eccentric crankpin 98 on the upper end of crankshaft 40 extends axially upwardly from top surface 85 of thrust plate 84 and is received within bore 96, whereby roller 94 is eccentrically journalled about eccentric crankpin 98. Roller 94 and crankpin 98 are received within a cylindrical well 100 defined by lower hub portion 102 on the bottom of orbiting scroll member 54. Roller 94 is journalled for rotation within well 100 by means of sleeve bearing 104, which is press fit into well 100. Sleeve bearing 104 is preferably a steel-backed bronze bushing. Further, hollow roll pin 106 is press fit into bore 108 of roller 94 and extends into pocket 110 of thrust plate 84 so that roller 94 is restrained from pivoting completely about crankpin 98. This restraint against pivoting is used primarily during assembly to keep roller 94 within a range of positions to assure easy assembly of orbiting scroll member 54 and fixed scroll member 52.

When crankshaft 40 is rotated by motor 30, the operation of eccentric crankpin 98 and roller 94 within well 100 causes orbiting scroll member 54 to orbit with respect to fixed scroll member 52. Roller 94 pivots slightly about crankpin 98 so that eccentric drive mechanism 82 functions as a conventional swing-link radial compliance mechanism to promote sealing engagement between fixed wrap 70 and orbiting wrap 78.

Figure 2:
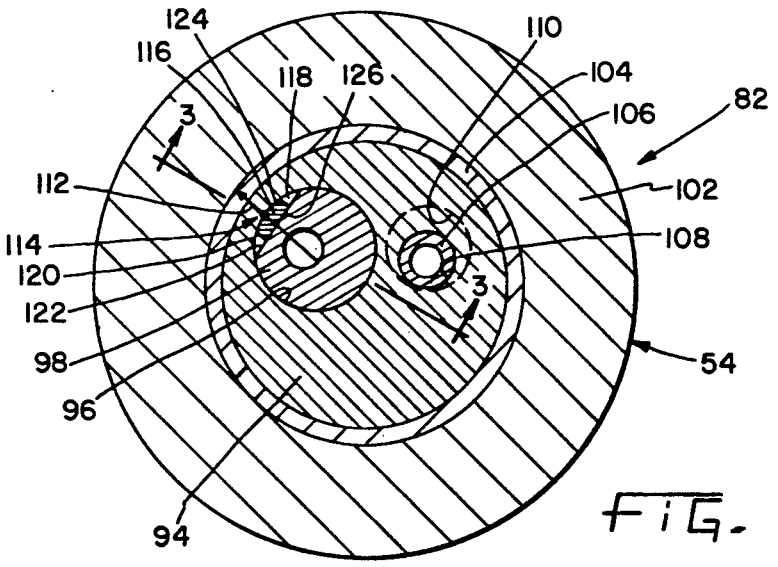
FIG. 2 is a view in cross section taken along view lines 2—2 of FIG. 1.

The swing-link radial compliance mechanism imparts a radially outwardly biased drive force to orbiting wrap 78, which acts generally along a line of force that is tangential to the orbiting motion of orbiting wrap 78, represented by arrow 112 in FIG. 2. As previously described, perturbations during operation of the swing-link mechanism cause chattering of the roller relative to the crankpin. The chattering vibrations result in rapid back and forth movement of the roller relative to the crankpin with an extremely small, almost microscopic, displacement focused at friction point 114 where arrow 112 intersects the circumference of axial bore 96. Friction point 114 indicates where the maximum point of the drive force exists during rotation of crankshaft 40. In prior art structures, the crankpin and the bore abutted at an axial line of contact running through the friction point and fretting tended to occur, causing the breakdown of molecular bonds between the materials of the crankpin and roller and very severe and localized wear.

Figure 3:
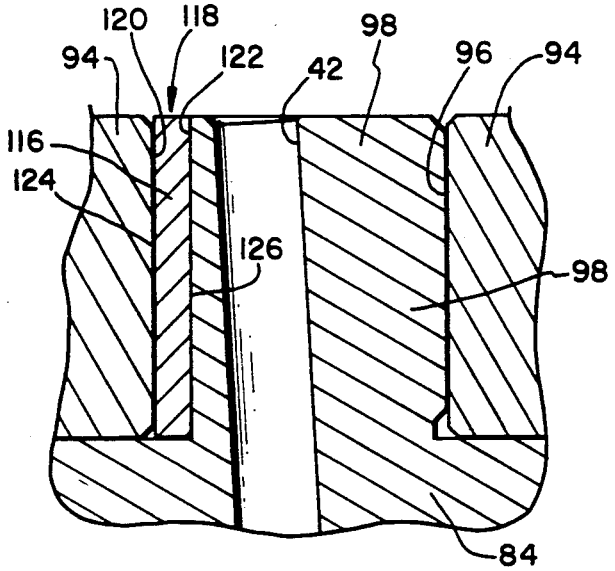
FIG. 3 is a view in cross section taken along view lines 3—3 of FIG. 2.

In accordance with the present invention, wedge 116 is disposed within bearing cavity 118, see FIGS. 2 and 3. Arc surface 120 of bore 96 and planar surface 122 of crankpin 98 define cavity 118, with planar surface 122 being generally perpendicular to the line of force indicated at arrow 112. Wedge 116 is provided to transmit frictional forces from the chattering vibrations focused at friction point 114 to sliding motion along planar surface 122 as discussed below in regards to FIGS. 5, 6, and 7.

Figure 4:
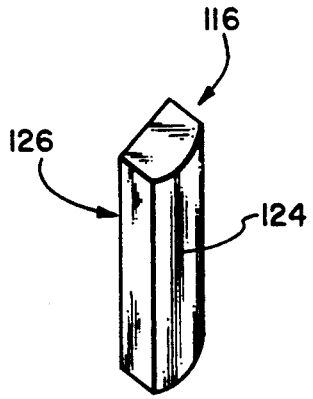
FIG. 4 is a perspective view of a bearing wedge of the present invention.

Referring to FIG. 4, wedge 116 includes an arcuate surface 124 and a flat surface 126. Arcuate surface 124 has a slightly more acute curve, i.e., generated by a smaller arc radius, than the curve defined by arc portion 120. Flat surface 126 abuts planar surface 122 at substantially every point of surface 126 and forms a bearing contact with surface 122. The radial width of wedge 116 is slightly smaller than the available radial width of cavity 118 so that wedge 116 has freedom to move within cavity 118. However, a relatively small difference in radial widths of wedge 116 and cavity 118 is desired so that wedge 116 receives the chattering vibrations from friction point 114. Preferably, wedge 116 has a radial width of approximately 0.200 inch and cavity 118 has a width of approximately 0.300 inch. Also, wedge 116 has an arc width approximately half the arc width of planar surface 122 to accommodate a rocking motion. Wedge 116 is made of a suitable bearing material, such as powdered metal, iron, aluminum, or bronze.

Figure 5:
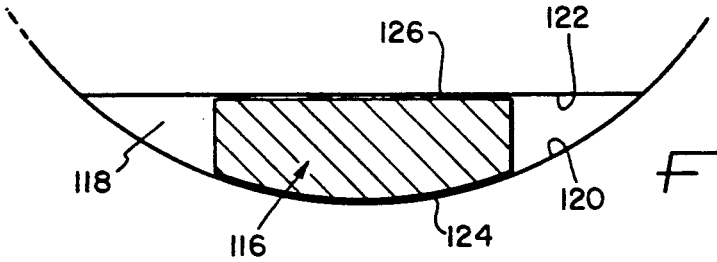
FIG. 5 is a schematic view in cross section of the bearing wedge in the middle of the bearing cavity.
Figure 6:
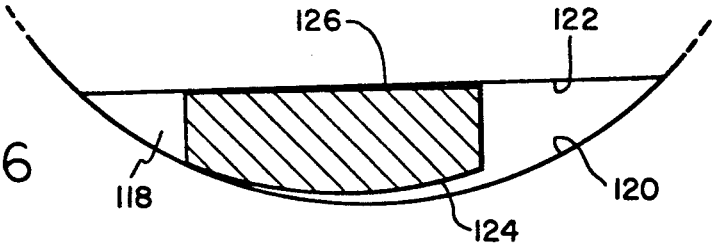
FIG. 6 is a schematic view in cross section of the bearing wedge to the right side in the bearing cavity.
Figure 7:
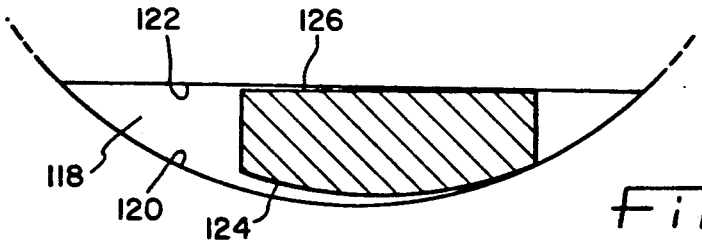
FIG. 7 is a schematic view in cross section of the bearing wedge to the other side in the bearing cavity.

Referring to FIGS. 5, 6, and 7, the manner in which wedge 116 transmits the chattering vibrations from friction point 114 to planar surface 122 is depicted. In FIG. 5, a static or equilibrium position of wedge 116 is shown, wherein wedge 116 is generally centered within cavity 118. In this position, flat surface 126 and arcuate surface 124 of wedge 116 may or may not be directly contacting with planar surface 122 or arc surface 120, respectively, depending on whether there is any deformation of roller 102 to decrease the radial width of cavity 118. After chattering vibrations occur from operation of the swing-ling compliance mechanism, wedge 116 receives perturbations which causes the left side of arcuate surface 124 to abut arc surface 120 as shown in FIG. 6. However, note that in FIG. 6 the left hand portions of surfaces 124 and 120 are abutting but that the right hand portions of surfaces 124 and 120 are separated by a significant distance.

This distance is significant because it is sufficiently large to induce lubricating oil to enter between the right hand portions of surfaces 124 and 120. Also, at some point during the travel of wedge 116 from the position of FIG. 5 to the position of FIG. 6, surfaces 122 and 126 came into contact. The contact of surfaces 122 and 126 is a bearing contact because the chattering vibrations focused at friction point 114 is transmitted first to a point on arcuate surface 124, then through wedge 116, and finally to all the points of flat surface 126 to be absorbed by planar surface 122 of crankpin 98.

Similarly, after more chattering vibrations wedge 116 receives more perturbations which cause wedge 116 and the right side of arcuate surface 124 to abut arc surface 120, as shown in FIG. 7. The right hand portions of surfaces 124 and 120 are abutting while the left hand portions of surfaces 124 and 120 are separated by a significant distance. During movement from the position of FIG. 6 to the position of FIG. 7, wedge 116 rocks within cavity 118 and also induces lubricating oil to enter between the left hand portions of surfaces 124 and 120. Also, the bearing contact of surfaces 122 and 126 aid in absorbing the frictional forces created by the rocking movement and transmit it first to a point on right hand side of arcuate surface 124, then through wedge 116, and finally to the bearing contact of flat surface 126 and planar surface 122.

Figure 8:
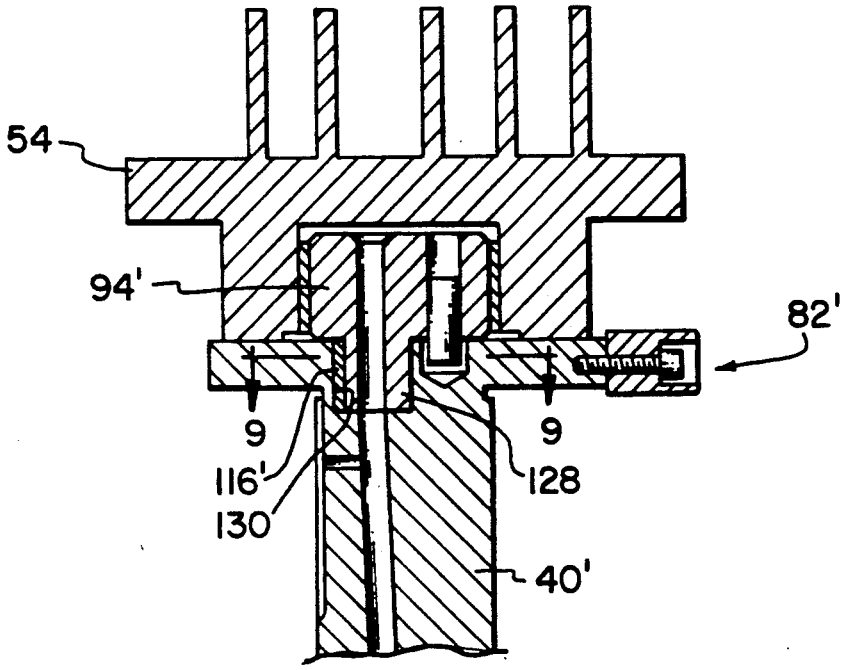
FIG. 8 is a view in cross section of an alternative embodiment of the roller and crankshaft.
Figure 9:
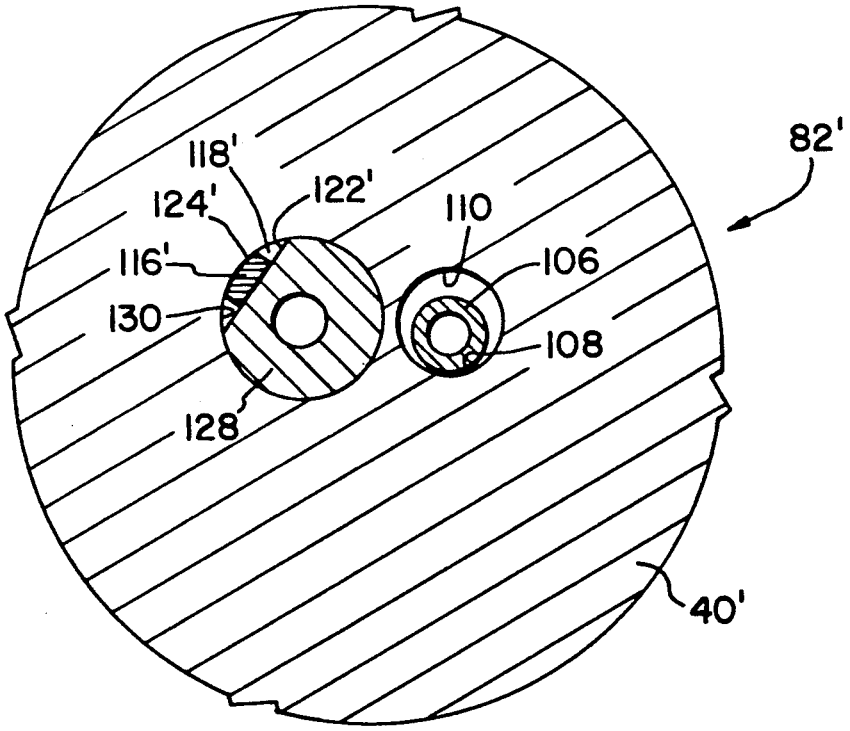
FIG. 9 is a view in cross section taken along view lines 9—9 of FIG. 8.

An alternative embodiment of the present invention is shown in FIGS. 8 and 9. The alternative eccentric drive mechanism 821 includes crankshaft 40' with an eccentric axial bore 130 which receives pin 128 of roller 94'. Pin 128 includes planar surface 122' which with accurate surface 124' of bore 130 defines cavity 118' which contains wedge 116', allowing wedge 116' to distribute chattering vibrations over planar surface 122' in a manner similar to that described above relating to FIGS. 5, 6, and 7.

It will be appreciated that the foregoing description of a preferred embodiment of the invention is presented by way of illustration only and not by way of any limitation, and that various alternatives and modifications may be made to the illustrated embodiment without departing from the spirit and scope of the invention.

What is claimed is:

1. A compressor comprising:

a housing;

a crankshaft rotatably disposed within said housing, said crankshaft including an eccentric portion;

a scroll compression means for compressing refrigerant disposed in said housing, said scroll compression means including a fixed scroll wrap and an orbiting scroll wrap;

radial compliance means for imparting orbiting motion to said orbiting scroll wrap, said radial compliance means operably connected to said crankshaft eccentric portion and said orbiting scroll wrap, said radial compliance means including roller means for engaging said eccentric portion; and bearing means for distributing frictional forces between said crankshaft eccentric portion and said roller means at a line of force being generally tangential to said orbiting motion, said bearing means disposed in a bearing cavity defined by a planar surface of one of said crankshaft eccentric portion and said roller means, said cavity also defined by an arc surface of the other of said crankshaft eccentric portion and said roller means, said bearing means including a wedge of a size smaller than said bearing cavity so as to be movable therein, said wedge having a flat surface engaging said planar surface and an arcuate surface engaging said arc surface whereby chattering vibrations which occur during rotation of said crankshaft at said line of force are translated to sliding motion of said bearing means on said planar surface.

2. The scroll compressor of claim 1 wherein said wedge has a length approximately half of the length of said planar surface.

3. The scroll compressor of claim 1 wherein said wedge comprises a powdered metal material.

4. The scroll compressor of claim 1 wherein said wedge has a size which accommodates rocking movement of said wedge.

5. The scroll compressor of claim 1 further comprising means for supplying lubricating oil to said bearing cavity.

6. In a scroll compressor, which comprises a crankshaft rotatably disposed within a housing and having an eccentric portion, a scroll mechanism including a fixed scroll wrap, an orbiting scroll wrap and a roller, means for causing the orbiting scroll wrap to orbit, and a bearing arrangement comprising:

means defining a bearing cavity between the eccentric portion of the crankshaft and the roller which rotatably supports the orbiting scroll wrap, said cavity having a generally cylindrical arc surface and a planar surface;

a wedge disposed within said cavity and being of a size smaller than said cavity so as to be movable therein, said wedge having a flat surface slidably abutting said planar surface, said wedge having an arcuate surface abutting said arc surface, said wedge being capable of sideways movement within said cavity, with said arcuate surface shaped to allow said wedge to transmit chattering vibrations of said crankshaft and said roller over said planar surface.

7. The scroll compressor of claim 6 wherein said wedge has a length approximately half of the length of said planar surface.

8. The scroll compressor of claim 6 wherein said wedge comprises a powdered metal material.

9. The scroll compressor of claim 6 wherein said wedge has a size which accommodates rocking movement of said wedge.

10. The scroll compressor of claim 6 further comprising means for supplying lubricating oil to said bearing cavity.

11. In a scroll compressor including a fixed scroll member, an orbiting scroll member having a cylindrical drive well, a rotatable crankshaft having an eccentric crankpin, and roller means for providing radial compliance between said orbiting scroll member and said crankpin, said roller means rotatably journalled in said drive well and having an eccentric cylindrical bore pivotally receiving said crankpin, whereby rotation of said crankshaft imparts a radially outwardly biased force causing orbital motion of said orbiting scroll member, said roller means causing said orbiting scroll member to radially comply with said fixed scroll member, said roller means pivotally moving relative to said crankpin and producing chattering vibrations which tend to cause wear along an axial line of contact between said roller means and said crankpin at the maximum point of said radially outwardly biased force, means for converting said chattering vibrations of said roller means and said crankpin along said axial line of contact to relative motion between two adjacent planar bearing surfaces, comprising:

means defining a cavity between an axially extending planar surface of said crankpin and an arc surface of said roller means which defines said cylindrical bore; and a wedge means for transmitting said chattering vibrations, said wedge means disposed within said said wedge means being of a size smaller than said cavity so as to be movable therein, cavity, said wedge means including an arcuate surface adjacent said arc surface and a flat surface adjacent said planar surface, said flat surface and said planar surface forming a bearing contact whereby said wedge means slides laterally within said cavity along said planar surface to distribute frictional forces caused by said chattering vibrations along said planar surface.

12. The scroll compressor of claim 11 wherein said wedge means has a length approximately half of the length of said planar surface.

13. The scroll compressor of claim 11 wherein said wedge means comprises a powdered metal material.

14. The scroll compressor of claim 11 wherein said wedge means has a size which accommodates rocking movement of said wedge.

15. The scroll compressor of claim 11 further comprising means for supplying lubricating oil to said bearing cavity.

16. A hermetic scroll compressor for compressing refrigerant fluid, comprising:

a housing;

a scroll compressor mechanism disposed within said housing, said mechanism including a fixed scroll member and an orbiting scroll member, said orbiting scroll member including a cylindrical well;

a rotatable crankshaft including one of an eccentric crank portion and an eccentric cylindrical bore;

a roller member including the other of an eccentric crank portion and an eccentric cylindrical bore, said eccentric crank portion being disposed within said eccentric cylindrical bore, and said roller member being rotatably journalled within said cylindrical well to impart radially outwardly biased force to said orbiting scroll member upon rotation of said crankshaft;

said eccentric crank portion having a generally cylindrical outer surface corresponding to the shape of said cylindrical bore, said eccentric crank portion further including a planar surface interrupting said generally cylindrical outer surface, said planar surface and an arc surface of said cylindrical bore defining a bearing cavity; and a wedge member disposed within said bearing cavity and being of a size smaller than said cavity so as to be movable therein, said wedge member including an arcuate surface adjacent said arc surface of said cylindrical bore, and a flat surface adjacent said planar surface, said flat surface and said planar surface forming a bearing contact whereby said roller member and said crankshaft cause chattering vibrations and said wedge member transmits said chattering vibrations along said planar surface.

17. The scroll compressor of claim 16 wherein said wedge member has a length approximately half of the length of said planar surface.

18. The scroll compressor of claim 16 wherein said wedge member comprises a powdered metal material.

19. The scroll compressor of claim 16 wherein said wedge member has a size which accommodates rocking movement of said wedge.

20. The scroll compressor of claim 16 further comprising means for supplying lubricating oil to said bearing cavity.

* * * * *